United States Patent [19]

Forsbäck et al.

[11] 4,232,410

[45] Nov. 11, 1980

[54] WATER CLOSET

[75] Inventors: Torbjörn Forsbäck, Ekenäs; Arvo Förbom, Vantaa, both of Finland

[73] Assignee: Oy Wartsila Ab, Helsinki, Finland

[21] Appl. No.: 969,860

[22] Filed: Dec. 15, 1978

[51] Int. Cl.[3] ..... E03D 11/18

[52] U.S. Cl. ..... 4/415; 4/428; 4/344

[58] Field of Search ..... 4/421, 425, 428, 426, 4/344, 328, 415

[56] References Cited

U.S. PATENT DOCUMENTS

| | | | |
|---|---|---|---|
| 577,900 | 3/1897 | Wallace | 4/428 |
| 764,912 | 7/1904 | Carson | 4/428 |
| 1,067,096 | 7/1913 | Cochran | 4/428 |
| 1,759,574 | 5/1930 | Hollenweger | 4/428 |
| 2,030,559 | 2/1936 | Zwermann | 4/425 |

*Primary Examiner*—Lenard A. Footland

*Attorney, Agent, or Firm*—J. Harold Nissen

[57] ABSTRACT

A water closet including a body portion with an upper level and a lower level, and integral with the body portion, a closet bowl and an outlet conduit forming an odor seal at the bottom of the bowl. The odor seal has an outlet crest determining its highest water level. There is a flush water container adjacent to the body portion and means for flushing the closet bowl with water passing by gravity from the flush water container through the bowl and the outlet conduit. Further, the odor seal outlet crest is at a height level of at least 50 percent of the height of the upper level of the body portion measured from the lower level thereof, and close to the upper level there is an annular flush duct of substantially bottomless configuration opening into the bowl at a level above the odor seal outlet crest, and, in addition, the outlet conduit has a constriction at its outlet end.

15 Claims, 1 Drawing Figure

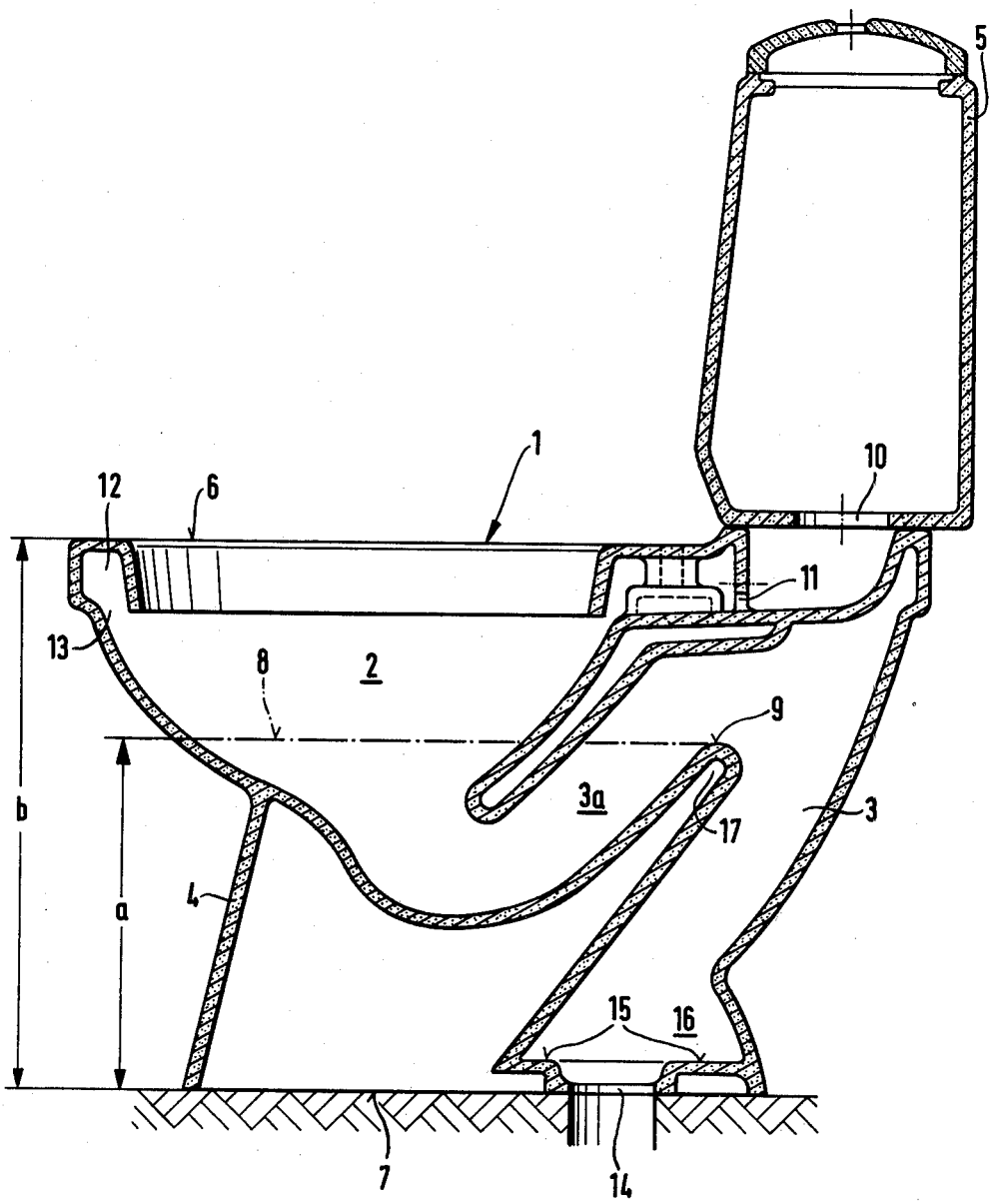
5
1
10
12
6
11
13
8
2
9
3a
3
17
b
a
4
15
16
7
14

WATER CLOSET

BACKGROUND OF THE INVENTION

The invention relates to a water closet with a gravity operated flush water system. More particularly, the invention is concerned with a water closet including a body portion with an upper level and a lower level, and integral with said body portion a closet bowl and an outlet conduit forming an odor seal at the bottom of said bowl, said odor seal having an outlet crest determining the highest water level of said odor seal, further a flush water container adjacent to said body portion and means for flushing said closet bowl by means of water passing by gravity from said flush water container through said bowl and said outlet conduit.

One object of the invention is to create a novel water closet design having siphon flushing and a low flush water consumption. Siphon flushing means that the flushing fills the outlet conduit downstream of the odor seal with water so that the outlet functions like a siphon and sucks the water out from the bowl and the odor seal due to gravity acting on the water filling a downwards directed portion of the outlet conduit, This gives a very effective flushing but known water closets with this kind of flushing have a very great flush water consumption and also a very complicated design of the outlet conduit which makes the manufacture of the water closet difficult and expensive. Known water closet of this type are shown, for example, in U.S. Pat. Nos. 3,224,013 and 2,116,528.

SUMMARY OF THE INVENTION

The present invention provides a solution to the problem of making a siphon flushing closet with low water consumption and an uncomplicated design. The invention is characterized by the combination of a number of features, some of which are known per se. These features are the following:

(a) said odor seal outlet crest is at a height level of at least 50 percent of the height of said upper level measured from said lower level;

(b) close to said upper level there is an annular flush duct of substantially bottomless configuration opening into said bowl at a level above said odor seal outlet crest;

(c) said outlet conduit has a constriction at its outlet end.

Thorough tests have shown that a water closet in which the features mentioned above have been combined fulfils the object of the invention. The odor seal must be at a relatively high level so that it will be possible to form the necessary siphon conduit in the water closet. This is important because the water closet manufacturer has no control of how the outlet conduit outside the water closet is made. Therefore, proper means for obtaining siphon flushing must be present in the water closet itself.

It is also important that the annular flush duct close to the upper level of the closet body is of substantially bottomless configuration and opens directly into the closet bowl above the highest possible water level of the odor seal. By this means the inertia of the flush water will be great enough to start a rapid flushing operation, which is necessary for obtaining siphon flushing.

In known water closets the outlet conduit usually has a very complicated form with several sharp curves, the object of which is to slow down the water flow at the beginning of the flushing operation so as to form a water plug necessary for obtaining siphon action. Obviously, a complicated form of the outlet conduit makes manufacture of the water closet difficult and raises the manufacturing costs. According to the invention the same effect is obtained in a very simple way, that is, by arranging a constriction of the outlet conduit at its outlet end.

If this is done, the outlet conduit can be given a very uncomplicated form with only one sharp curve, while any other curve of the outlet conduit is at the most 60°, preferably at the most 45°.

A water closet according to the invention can be further improved by dimensioning said constriction of the outlet conduit so that the free cross-sectional area of the outlet conduit at said constriction is at least 10 percent, preferably at least 15 percent smaller than the smallest free cross-sectional area of the outlet conduit between said odor seal outlet crest and said constriction. This rather small reduction of the cross section area has proved to be quite sufficient in most cases. If a more definite braking of the water flow is desired, a distinct inside shoulder can be formed in the outlet conduit immediately before the constriction. This shoulder can be combined with an enlargement of the outlet conduit before the constriction. An enlargement can be made also without forming a distinct shoulder. The shoulder as well as the enlargement increases the flow resistance and makes it easier to form the water plug necessary for obtaining siphon action.

At the outlet crest of the odor seal the outlet conduit should make a sharp curve. The curve should preferably pass through an angle of between 150° and 180°. Thereby a favourable flow and a favourable form of the water closet are obtained.

In order to obtain low flush water consumption the volume of the odor seal should be kept relatively small. The volume of the odor seal means the volume of the bottom portion of the closet bowl and the inlet portion of the outlet conduit below the level of the odor seal outlet crest. This volume should normally be kept between 2 and 3.5 liters, preferably between 2.3 and 3.3. liters.

BRIEF DESCRIPTION OF THE DRAWING

The invention is illustrated in the attached drawing, the single FIGURE of which shows a vertical central section of a water closet according to the invention.

DESCRIPTION OF THE PREFERRED EMBODIMENT

In the drawing, the numeral 1 indicates the body portion of a water closet including a bowl portion 2 and an outlet conduit 3, both integral with the body 1. The water closet further includes a base portion 4, of which the downstream portion of the outlet conduit 3 forms a part, and a flush water container 5 which is carried by the body portion 1. The body 1 has an upper level 6 with the usual bowl opening and a lower level 7 forming the support level of the closet. An odor seal is formed by the bottom portion of the bowl 2 and the inlet end **3*a* of the outlet conduit 3. The odor seal is normally filled with water and the highest possible level 8 of the water contained therein is determined by the outlet crest 9** of the odor seal.

The drawing shows only those parts of the water closet and the flush water container which are usually made of vitreous china. Hence, the lids of the closet bowl, the water supply piping and the flushing devices included in the flush water container are not shown in the drawing. It should be understood, however, that the illustrated water closet is flushed by means of water flowing by gravity from the flush water container 5 into closet bowl 2. For this water flow there are provided openings 10 and 11 and further openings in the same partition wall as the opening 11, but at both sides of the sectional plane and therefore not visible in the drawing. Close to the upper level 6 of the body portion 1 there is an annular flush duct 12 of substantially bottomless configuration. This flush duct 12 opens into the bowl 2 at a level above the water level 8 of the odor seal. The flush water flows out from the annular duct 12 through a slot 13 between the inside surface of the closet bowl and the internal wall of the annular flush duct 12. This slot 13 is adapted to the flow of flush water so that the flush water is suitably distributed all over the inner surface of the closet bowl 2. It is essential that there is an open slot 13 and not, for instance, a plurality of small flush water openings.

When the flush water coming through the slot 13 is received by the odor seal, which is normally filled with water, the water level 8 rises and water starts flowing over the outlet crest 9 of the odor seal. By suitable dimensioning of the flush water system it is obtained that the water flowing out from the odor seal fills the more or less vertical downstream portion of the outlet conduit 3 and forms there a water plug which starts a siphon action emptying the odor seal very rapidly and effectively. For filling up the odor seal after a flushing operation an after-filling system is arranged as well known in water closets. It should be noted that the whole flushing operation is carried out by means of gravity only and no pressure fluid is needed in any part of it.

As clearly shown in the drawing the odor seal is located to a relatively high level. The outlet crest 9 of the odor seal determining the water level 8 is at a distance a from the bottom level 7 of the water closet which is more than 50 percent of the distance b between the lower level 7 and the upper level 6. Preferably, the distance a should be at least 60 percent of the distance b.

At the downstream end of the outlet conduit 3 there is a constricted opening 14. This opening is not very much smaller than the smallest free cross-sectional area downstream of the odor seal, but already a constriction of only 10 percent has proved to have a very favourable effect on the forming of a siphon action starting water plug. The effect of the constriction of the outlet conduit can be increased by arranging immediately in front of the constriction a distinct shoulder 15 and/or an enlargement 16. For practical reasons and due to the relatively great manufacturing tolerances it is in most cases suitable to aim at a constriction limiting the free cross-sectional area with at least 15 percent.

It should be noted that the outlet conduit 3 has a very simple configuration. It only makes one sharp curve through an angle of more than 45° and that is at the outlet crest 9 of the odor seal. This means that the outlet conduit consists of two practically straight portions. It is of advantage that the curve at the outlet crest of the odor seal is rather sharp and covers an angle of between 150° and 180°. A small wedge-formed free space 17 should be left between the two practically linear portions of the outlet conduit 3 in order to make it easier to manufacture the water closet.

The volume of the odor seal is the total volume of the bottom portion of the closet bowl 2 and the inlet portion **3*a* of the outlet conduit 3 up to the level 8 determined by the odor seal outlet crest 9**. The volume in question should be between 2 and 3.5. liters, preferably between 2.3 and 3.3 liters.

While there has been shown what is considered to be the preferred embodiment of the invention and the best mode thereof, it will be evident to those skilled in the art that various changes and modifications may be made therein without departing from the scope of the invention as defined by the attached claims.

We claim:

1. A water closet including a body portion with an upper level and a lower level, and integral with said body portion, a closet bowl and an outlet conduit forming an odor seal at the bottom of said bowl, said odor seal having an outlet crest determining the highest water level of said odor seal, further a flush water container adjacent to said body portion and means for flushing said closet bowl by means of water passing by gravity from said flush water container through said bowl and said outlet conduit, wherein the improvement consists in the combination of the following features:

(a) that said odor seal outlet crest is at a height level of at least 50 percent of the height of said upper level measured from said lower level;

(b) that close to said upper level there is an annular flush duct of substantially bottomless configuration opening into said bowl at a level above said odor seal outlet crest;

(c) that said outlet conduit has a constriction at its outlet end below said odor seal, said constriction being downstream of said odor seal

2. A water closet as claimed in claim 1, wherein, at said constriction, the free cross-sectional area of said outlet conduit is at least 10 percent smaller than its smallest free cross-sectional area between said odor seal outlet crest and said constriction.

3. A water closet as claimed in claim 1, wherein, at said constriction, the free cross-sectional area of said outlet conduit is at least 15 percent smaller than its smallest free cross-sectional area between said odor seal outlet crest and said constriction.

4. A water closet as claimed in claim 2 or 3, wherein there is a distinct shoulder formed in said outlet conduit immediately before said constriction.

5. A water closet as claimed in claim 2 or 3, wherein there is an enlargement of said outlet conduit immediately before said constriction.

6. A water closet as claimed in claim 2 or 3, wherein said outlet conduit includes a curve of between 150° and 180° at said odor seal outlet crest.

7. A water closet as claimed in claim 2 or 3, wherein the height level of said odor seal outlet crest is at least 60 percent of the height of said upper level measured form said lower level of said closet body portion.

8. A water closet as claimed in claim 2 or 3, wherein the volume of said odor seal is 2 to 3.5 liters.

9. A water closet as claimed in claim 2 or 3, wherein the volume of said odor seal is 2.3. to 3.3. liters.

10. A water closet as claimed in claim 1, wherein said outlet conduit, downstream of said odor seal, makes only one curve through an angle of more than 60°.

11. A water closet as claimed in claim 10, wherein said outlet conduit includes only one curve through more than 45°.

12. A water closet with gravity flushing including a body portion with an upper level and a lower level, and integral with said body portion, a closet bowl and an outlet conduit forming an odor seal at the bottom of said bowl, said odor seal having an outlet crest determining the highest water level of said odor seal, further a flush water container adjacent to said body portion and means for flushing said closet bowl by said gravity flushing by means of water passing by gravity from said flush water container through said bowl and said outlet conduit, wherein the improvement consists in the combination of the following features to provide for a low flush water consumption:

(a) that said odor seal outlet crest is at a height level of at least 50 percent of the height of said upper level measured from said lower level;

(b) that close to said upper level there is an annular flush duct of substantially bottomless configuration free of any constriction to form an open slot opening directly into said bowl at a level above said odor seal outlet crest;

(c) that said outlet conduit has a constriction at its outlet end at a level clearly below the entire odor seal; and, (d) that said closet bowl together with said outlet conduit are effectively free of sharp corners within the height level of said odor seal and said constriction is downstream of said odor seal.

13. A water closet as claimed in claim 12, wherein said constriction is at the mouth of the outlet end of said outlet conduit, the free cross-sectional area of said outlet conduit is at least 10 percent smaller than its smallest free cross-sectional area between said odor seal outlet crest and said constriction.

14. A water closet as claimed in claim 13, wherein said constriction is at least 15 percent smaller than said smallest free cross-sectional area, and there is surrounding said construction a distinct shoulder and an enlargement formed in said outlet conduit immediately before said constriction.

15. A water closet including a body portion with an upper level and a lower level, and integral with said body portion, a closet bowl and an outlet conduit forming an odor seal at the bottom of said bowl, said odor seal having an outlet crest determining the highest water level of said odor seal, further a flush water container adjacent to said body portion and means for flushing said closet bowl by means of water passing by gravity from said flush water container through said bowl and said outlet conduit, wherein the improvement consists in the combination of the following features:

(a) that said odor seal outlet crest is at a height level of at least 50 percent of the height of said upper level measured from said lower level;

(b) that close to said upper level there is an annular flush duct of substantially bottomless configuration opening into said bowl at a level above said odor seal outlet crest;

(c) that said outlet conduit has a constriction at its outlet end below said odor seal, said constriction being downstream of said odor seal and said constriction providing for a transition for the passage of the water by gravity out of said outlet conduit.

* * * * *